US006058547A

United States Patent [19]

Foster

[11] Patent Number: 6,058,547

[45] **Date of Patent: *May 9, 2000**

[54] DEVICE FOR REMOVING OBJECTS FROM ENCLOSED AREAS

[75] Inventor: Larry Foster, Oak Forest, Ill.

[73] Assignee: DML, LLC, West Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,511

[22] Filed: Feb. 6, 1997

[51] Int. Cl.[7] ..... B08B 9/04

[52] U.S. Cl. ..... 15/104.12; 15/104.05; 15/104.31; 15/104.09

[58] Field of Search ..... 15/104.09, 104.12, 15/104.13, 104.14, 104.31, 104.068, 104.069, 104.05

[56] References Cited

U.S. PATENT DOCUMENTS

| | | | |
|---|---|---|---|
| 1,593,044 | 7/1926 | Stubbs | 15/104.09 |
| 2,517,227 | 8/1950 | O'Leary | 15/104.09 |
| 4,001,911 | 1/1977 | Watson | 15/104.09 |
| 4,138,758 | 2/1979 | Dodge | 15/104.069 |
| 4,795,495 | 1/1989 | Dobson, Sr. | 15/104.14 |
| 5,257,435 | 11/1993 | Brewster | 15/104.068 |
| 5,335,388 | 8/1994 | Salecher | 15/104.12 |
| 5,418,997 | 5/1995 | Deprange | 15/104.31 |
| 5,658,103 | 8/1997 | Inokuchi | 15/104.09 |
| 5,745,948 | 5/1998 | Lloyd | 15/104.12 |
| 5,819,354 | 10/1998 | Alonso | 15/104.09 |

FOREIGN PATENT DOCUMENTS

| | | | |
|---|---|---|---|
| 2155733 | 5/1973 | Germany | 15/104.069 |

*Primary Examiner*—Randall E. Chin
*Attorney, Agent, or Firm*—Steven R. Trybus

[57] ABSTRACT

A device for removing objects from a contained area or pipeline. A cutting means comprising at least one rotating, semi-rigid cutting arm of sufficient diameter, length, and material such that it is rigid enough to cut an object while having sufficient flexibility to avoid damaging an interior wall of said pipeline and to increase cutting area during operation. The cutting member, attachable to a shaft which is rotated by a standard motor, rotates concentrically with a longitudinal axis of the pipeline causing the semi-rigid cutting arm to move and flex during operation. The device may be employed inside a pipeline in both axial directions toward either end of said pipeline.

7 Claims, 2 Drawing Sheets

(SEC. A-A)

DEVICE FOR REMOVING OBJECTS FROM ENCLOSED AREAS

TECHNICAL FIELD

This invention relates to removing objects from enclosed areas and more particularly to a rotary cutting tool for removing plant roots from sewage lines.

BACKGROUND ART

Many problems stem from the growth of roots in underground sanitary and storm sewers. For example, if plant roots are left untreated, they can cause line blockages, back-ups, and sewage system failure. Ultimately, such root growth typically causes shutdown of the sewer. It is therefore necessary to partially or totally remove roots from sewage lines.

The removal of plant roots from sewage lines poses several problems. In particular, when de-rooting a sewer, care must be taken to avoid damaging the above-ground foliage which is typically on private land and planted and cared for by a homeowner. Although the above-ground foliage may be delicate, it is important to eliminate as much of the root as possible to minimize its regrowth. If a root is not completely removed, as when one branch of a root is cut near its top, multiple roots may sprout from that branch which could aggravate the root problem.

Various methods that have been employed to remove such roots have hertofore proven unsatisfactory. The methods that have been used to combat the root blockage problem include the use of mechanical rodding machines, high pressure flushing machines, and various snaking and plumbing devices.

For example, to minimize or remove root blockage, high pressure flushing machines have been used. Such machines typically drive a hydraulic motor, residing at the end of a sewer flushing hose, and are used with various sized circular and rigid cutting devices such as saws. However, the use of such rigid saws poses several problems. In particular, due to the precision required and the risk of damage to the inside wall of a pipeline, operators of rigid saws are often unable or unwilling to use a large enough saw blade inside the sewage line which is necessary to fully cut the root. When that problem is coupled with the circumstances typically existing in sewage lines, such as the presence of offset joints or protruding tap-ins typically encountered in the field, often an undersized blade will be used. An undersized blade while minimizing these problems only partially removes root blockage. Such partial removal reduces the pipeline's effective inside diameter in comparison to its original, unobstructed diameter. Consequently, the hydraulic pump-motor system experiences reduced flow capacity and increased loading. Moreover, even an undersized rigid saw blade can get jammed in the sewer line which could damage the sewer cleaning equipment and require that the underground sewer line and the hydraulic motor be excavated and repaired or even replaced.

Another method for controlling root growth has employed the running of chains or snakes through a line. However, that method tends to have a hammering effect on the inside surface of a pipeline which could cause excessive wear or damage to the sewage line.

Another method for controlling roots employs spring-loaded, three-armed cutter blades. As is known in the art, sewage lines are typically substantially horizontal and slightly pitched to allow for sewage to flow through the line under gravity from one end of the line, typically where a manhole is located, to another end, typically where sewer cleaning equipment is based. Spring-loaded blades are disadvantageous since they cannot effectively operate in the upstream direction of the pipeline. In particular, due to the conical orientation of the rotating blades, if the cutter were operated in an upstream, concave direction, it would likely become stuck in the line once it encounters a root or other obstruction. Therefore, an operator of a sewer cleaning device must remember to start the cleaning device at the upstream end of the sewer line and allow it to sweep the line in a downstream direction away from the manhole and toward the sewer cleaning equipment. In addition, if the hydraulic motor and associated cleaning equipment is initially on the downstream end of the pipeline, the operator of the cleaning equipment is inconvenienced because the cleaning equipment must be moved upward to the upstream side of the pipeline before cleaning the line.

One purpose of the present invention, therefore, is to remove objects from the inside of pipelines, such as plant roots, without causing the root-removing equipment to get jammed in the line.

Another object of the present invention is to reduce the likelihood of damaging the line while providing for the maximum removal of objects throughout the full pipe diameter of the line.

Another object of the present invention is to allow a pipeline obstruction removal device to operate in either longitudinal direction toward either end of a pipeline.

Another object of the present invention is to provide a device that can easily operate in and be adaptable to pipelines having several different inside diameters.

Another object of the present invention is to provide a device for removing severely-impacted objects from pipelines. Still another object of the present invention is to provide an effective obstruction or plant root removing device adaptable to various hydraulic motors.

DISCLOSURE OF INVENTION

The invention discloses a device for removing objects from enclosed areas by using at least one rotating, semi-rigid cutting member. For example, the instant invention enables the removal of objects that are partially or totally obstructing the flow of fluid inside a pipeline. More particularly, objects such as plant roots, grease, scale, and other built-up solids may be removed from areas such as gravity sewers and pump station force mains.

The invention employs a cutting means comprising a cutting member for cutting objects that may obstruct the flow of fluid in a pipe. In the preferred embodiment of the invention, the cutting member preferably has two semi-rigid cutting arms. More particularly, each of two cutting arms are preferably comprised of a cable which, when moved at an appropriate speed, is of a sufficient diameter, length, and material to be advantageously semi-rigid; namely, the cutting arms are rigid enough to cut undesirable plant roots and yet flexible enough to flex, fray or otherwise move around fixed obstructions, such as offset joints or protruding tap-ins, to minimize the risks of damaging the fixed obstruction, the interior pipe wall, and the cutting arms.

The cutting member rotates during its operation. The cutting member preferably is attached to a shaft which, preferably, is rotated by a root cutting motor such as a standard, pre-existing sewage-cleaning motor. Thus, a standard motor in the industry that is operated by hydraulic flushing machines is adaptable to the invention for rotating the cutting member. Preferably, the axis of rotation of a shaft and the cutting member attached thereto is concentric to the longitudinal axis of the pipeline. In other words, in the preferred embodiment, the present invention is radially centered in the pipe as it travels longitudinally through the sewer. The circumferential movement of the cutting arms is sufficient to provide a cutting action in an area substantially perpendicular to the axis of rotation of the cutting member. Orienting the cutting arms substantially perpendicular to the shaft generally optimizes beneficial cutting arm fraying and therefore root removal coverage area. The cutting area may not be perpendicular to the rotating shaft during operation since the cutting arms are designed to flex around fixed obstructions they may encounter.

BRIEF DESCRIPTION OF DRAWINGS

For a more complete understanding of this invention, reference now should be made to the embodiment illustrated in greater detail in the accompanying drawings which describe the invention by way of example only. In the drawings.

MODES FOR CARRYING OUT THE INVENTION

While the particular embodiment of the invention illustrated in FIGS. 1 through 4 can be applied to a particular object, it will be recognized by those skilled in the art that by making alterations to the dimensions, shapes and features of aspects of this invention, the invention is useful for other objects or applications.

The invention discloses a device for cleaning objects from enclosed areas which includes a cutting member (5) having at least one rotatable semi-rigid cutting arm (20) and an attachment member (10) for attaching the cutting arm (20) to the cutting member (5).

Figure 1:
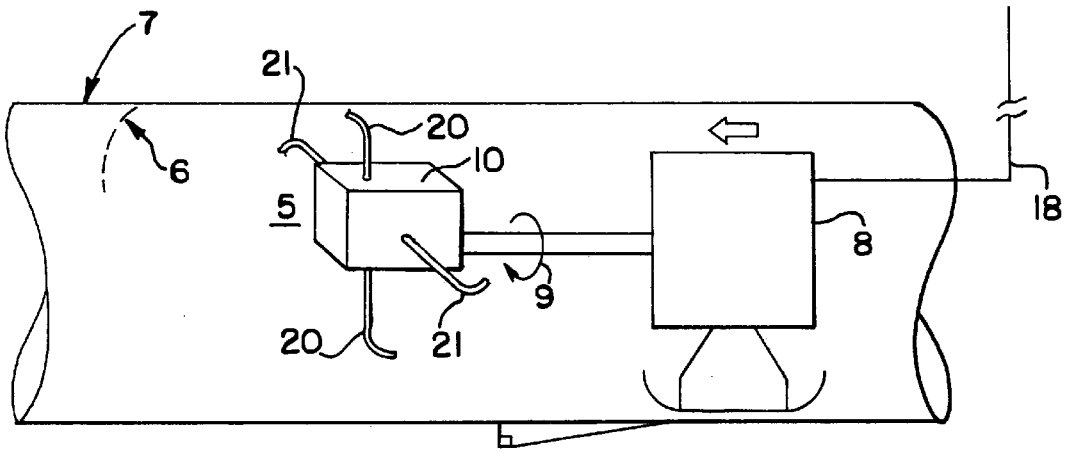
FIG. 1 shows a schematic of an embodiment of the invention residing in a pipeline.

FIG. 1 shows a schematic of the preferred embodiment of the invention. As shown in FIG. 1, an attachment member (10) is attachable to a motor shaft (9) which is connected to a motor (8). The attachment member (10) preferably has attached thereto two cutting arms; namely a first cutting arm (20) and a second cutting arm (21). First and second cutting arms (20) and (21) each preferably extend out of attachment member (10) in two places such that there are four cutting blades. The attachment member (10), the cutting arms (20) and (21), as well as other objects shown in FIG. 4 comprise a cutting member (5).

During operation, the motor (8) rotates the shaft (9), the attachment member (10), and the cutting arms (20) and (21) about the axis of the motor shaft (9) as shown in FIG. 1. For example, if a pipeline (7) is horizontal, the shaft (9) and cutting arms (20) and (21) attached thereto preferably rotate at a sufficient speed about an axis substantially parallel to the longitudinal center axis of the pipeline (7) such that first and second cutting arms (20) and (21) create a circular cutting area in a substantially vertical plane. Preferably, cutting member (5) rotates at an angular speed of approximately 320 rotations per minute which has been found to create sufficient cutting force for the application and preferred embodiment described herein. The cutting member (5) preferably may be "swept" or moved along the longitudinal length of the pipeline (7) until most if not all undesirable obstructions have been removed. The cutting member (5) preferably has the capability to sweep pipeline (7) in a direction toward either end of pipeline (7) which is typically slightly pitched at an angle of approximately two degrees, Preferably, the sweeping direction is upstream toward the upward-pitching end of pipeline (7) so that the roots cut by the cutting members (5) may be washed away by the fluid that will flow downstream pipeline (7) under gravity.

The movement or sweeping of cutting member (5) along pipeline (7) is preferably accomplished as follows. An above-ground pump is used to pump water through a hose (18) to motor (8) which may be mounted on propulsion skids. A portion of the water supplied to motor (8) is used to rotate motor shaft (9) and the remaining portion of the water supplied to motor (8) is fed through several jet nozzles connected to motor (8) which thereby propel motor (8), shaft (9), and cutting member (5) through the pipeline (7) at a speed determined by the operator of the device, as generally shown in FIG. 1. If the sweeping speed is too great, the performance of the device will suffer.

During operation of the preferred embodiment of the invention, the circular movement of the first and second cutting arms (20) and (21) is such that they circumscribe an area at or near an interior wall (6) of a pipeline (7). The preferred embodiment of the invention is preferably compatible with and operational in a pipeline (7) having an interior wall (6) that may be made of several different types of pipe construction material. For example, the interior wall (6) can be vitrified clay pipe (VCP), polyvinyl chloride (PVC), reinforced concrete pipe (RCP), cast iron pipe (CIP), as well as other types of materials. Although the invention may be operated in pipelines, it is useful for and compatible with several other applications and settings.

Figure 2:
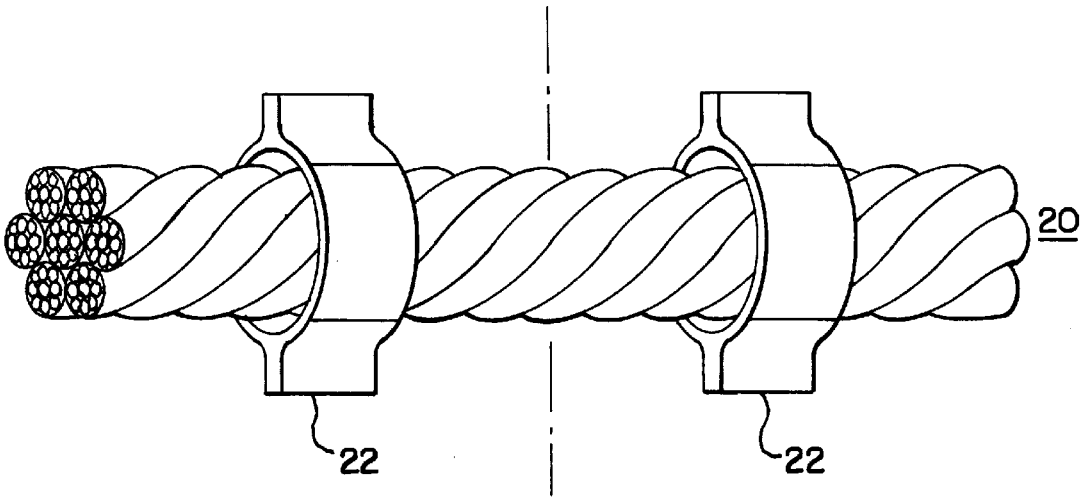
FIG. 2 is a schematic perspective view of a cutting arm.

As shown in FIG. 2, first and second cutting arms (20) and (21) each are preferably comprised of a plurality of smaller cables each of which may be comprised of a plurality of wires. In addition, first and second cutting arms (20) and (21) are semi-rigid as described herein; therefore, first and second cutting arms (20) and (21) can be made of various materials in various shapes and need not be limited to cables. However, the use of cables is preferred since, as used in the preferred mode of operation, the preferred cable as disclosed herein will flex and fray when the device is operated thereby allowing the device to avoid fixed obstructions that prior art devices would likely be unable to avoid as well as increasing the cutting area without damaging the interior wall (6) of pipeline (7).

Regardless of the material or shape chooses for first and second cutting arms (20) and (21), it is an essential aspect of this invention that first and second cutting arms (20) and (21) are semi-rigid such that they have the correct balance of stiffness and flexibility for the desired application consistent with the objects of this invention. In particular, the first and second cutting arms (20) and (21) are preferably of sufficient diameter, length, and material to be rigid enough to cut the undesired object or plant root from an area or pipeline (7) when the first and second cutting arms (20) and (21) are moved at a sufficient cutting speed and yet the first and second cutting arms (20) and (21) are flexible enough to avoid increasing the risk of significantly damaging the interior wall (6) of pipeline (7) in which the device is operating.

Preferably, two cutting arms (20) and (21) are employed whereby each cutting arm is comprised of a 617 steel cable having a half-inch diameter. As is known in the art, a "617" cable is comprised of 6 smaller cables, each one being comprised of 17 strands, helically braided to form one cable. Alternatively, the cable of each cutting arm may be of unequal stiffness, diameter, length, or shape wherein, for example, one cable may be slightly stiffer, longer, and larger in diameter than the other so that the combined cutting properties of the cutting arms (20) and (21) are optimized for the desired application and matched with the properties of the obstruction to be cut and the material of the interior wall (6) of pipeline (7). The length of each cable is preferably determined based on the inside diameter of pipeline (7) to be cleaned and the difficulty of removal of the degree of root-impactedness encountered. The length is preferably slightly longer than the inside diameter of pipeline (7) so that, after compensating for the deflection and fraying of the cutting arms (20) and (21) resulting from the circular movement during operation, the ends of the cutting arms (20) and (21) preferably extend substantially through the circumference of the interior wall (6) of pipeline (7). For example, nine inch long first and second cutting arms (20) and (21) are preferably used for a pipeline (7) having an inside diameter of eight inches although the first and second cutting arms (20) and (21) can be alternatively adapted or designed to fit the desired application.

For example, the following alternative embodiment of the invention is useful for the removal of severely-impacted or otherwise extremely difficult-to-remove roots. During the preferred operation of the following alternative embodiment, cutting member (5) is swept along pipeline (7) such that first cutting arm (20) will encounter a root before second cutting arm (21). If the length of first cutting arm (20) were comparable or slightly longer than the inside diameter of pipeline (7) as in the preferred embodiment, penetration of a severely-impacted root would likely be difficult. An alternative embodiment solves that problem by making first cutting arm (20) shorter in length than second cutting arm (21) to provide a tapered drill-type or torpedo effect whereby first cutting arm (20) is able to cut and remove enough obstructive material to facilitate the full penetration of cutting member (5) and second cutting arm (21) through the severe obstruction to allow second cutting arm (21) to completely remove the remaining obstruction. Due to the severely-impacted root growth for which this alternative embodiment is designed, second cutting arm (21) should be slightly shorter than it would normally be in the preferred embodiment. For example, if a severely root-impacted pipeline (7) were eight inches in inside diameter, an alternative embodiment of the invention might have a first cutting arm (20), for example, of six inches in length and a second cutting arm (21), for example, eight inches in length.

As shown in FIG. 2, each cutting arm (20) and (21) preferably has two cable sleeves (22) which serve at least four purposes. First, the sleeves (22) may be of a particular length and stiffness to add an optimum degree of stiffness to the cutting arms (20) and (21) by the sleeves (22) placed over them. Thus, the sleeves (22) enhance the semi-rigid and cutting effects of cutting arms (20) and (21). The stiffness of sleeves (22) preferably is matched with respect to the material on interior wall (6) of pipeline (7) and the toughness of the obstruction to be removed. For example, the sleeves (22) preferably are 1.25 inches in length and made of a suitable material preferably, for example, galvanized steel tubing. Second, the sleeves (22) serve to hold together a cable or a plurality of cables which comprise cutting arms (20) and (21) and to reduce excessive fraying of the cables. Third, the sleeves (22), once applied around each cutting arm (20) and (21), help to center each cutting arm in the attachment member (10) such that the two ends of each cutting arm (20) and (21) extend equal distances from the attachment member (10) as described in greater detail below. Finally, the sleeves (22) may also help to prevent radial slippage of cutting arms (20) and (21) during the rotation of the attachment member (10). Preferably, once a cutting arm (20) or (21) is centered with respect to attachment member (10), each arm has two ends that extend equal distances radially outward from attachment member (10).

Figure 3:
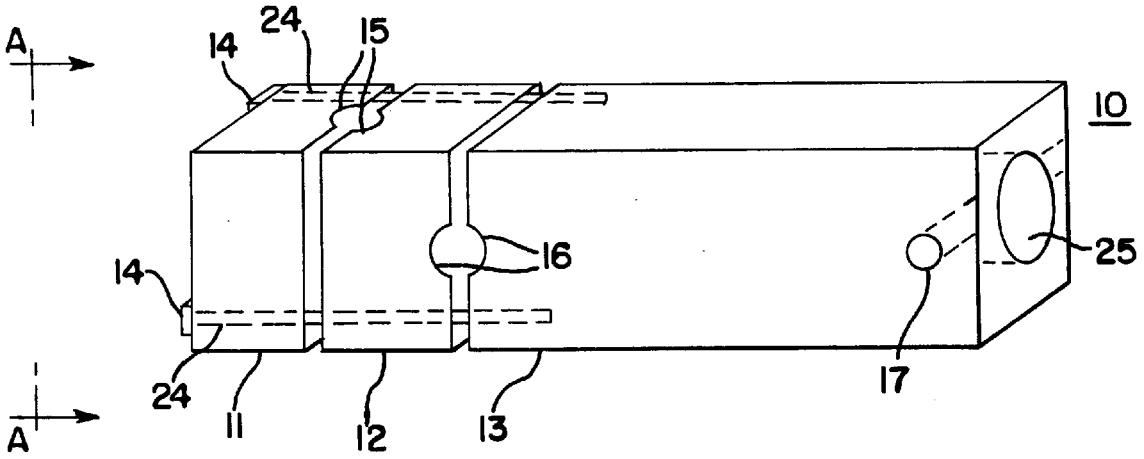
FIG. 3 is a side schematic perspective view of an attachment member.

FIG. 3 is a schematic of a side perspective view of the attachment member (10). The attachment member (10) is preferably fabricated from a section of material such as, for example, a square cylindrical block of material as follows. Attachment member (10) preferably is short in length to minimize the difficulty involved in fitting and lowering the entire device, including the attachment member (10), motor shaft (9), and motor (8), into an enclosed area or manhole of limited size or diameter and yet attachment member (10) must be long enough to adequately secure itself on shaft (8) and preferably to secure two cutting arms; namely cutting arms (20) and (21). Preferably, a 4.75 inch long cylindrical block of a suitable material, such as steel, having a square cross section with each side of the square having 1.5 inch long sides. The embodiment described assumes that two cutting arms (20) and (21) are employed although, as discussed herein, the invention need not be so limited. First, two holes are drilled into the block so that one may accommodate the first cutting arm (20) and the other hole may accommodate the second cutting arm (21). The diameter of each hole preferably is equal to or slightly larger than the diameter of the corresponding cutting arm (20) and (21) to be placed therein. Thus, if a cutting arm having a diameter of 0.5 inches is used, then a hole of approximately 0.5 inches diameter should be bored. The two holes may be oriented in various ways, preferably, for example, perpendicular to each other and in a plane substantially perpendicular to a longitudinal axis of the cutting member (5). The two holes form front and end insertion grooves (15) and (16) for accommodating cutting arms (20) and (21) and may be offset from each other by about one inch along the longitudinal axis of the square cylindrical block as shown in FIG. 3.

Once the holes have been drilled, the block preferably is cut along the longitudinal center line of each hole as shown in FIG. 3. After those cuts have been made, the block will be in three separate sections which now comprise the attachment member (10); namely a front section (11), a middle section (12), and an end section (13). Front section (11) will be at the far end from shaft (9) and is described as "front" section since it is in the front of cutting member (5) relative to the device's preferred direction of movement along pipeline (7). Likewise, end section (13), being at the near end of shaft (9), is called "end" section since it would be in the rear of cutting member (5) as it preferably moves along pipeline (7). A similar "front" and "end" nomenclature is used to describe other elements of the invention. A middle section (12) is between front section (11) and end section (13). The end section (13) and the middle section (12) preferably have corresponding front end insertion grooves (15) for accommodating a first cutting arm (20) placed toward the far end of shaft (9) at the end of attachment member (10). The middles section (12) and the end section (13) preferably have corresponding end arm insertion grooves (16) for accommodating a second cutting arm (21). As shown in FIG. 3, front and end arm insertion grooves (15) and (16) preferably are substantially perpendicular and longitudinally offset by about one inch from each other.

Figure 4:
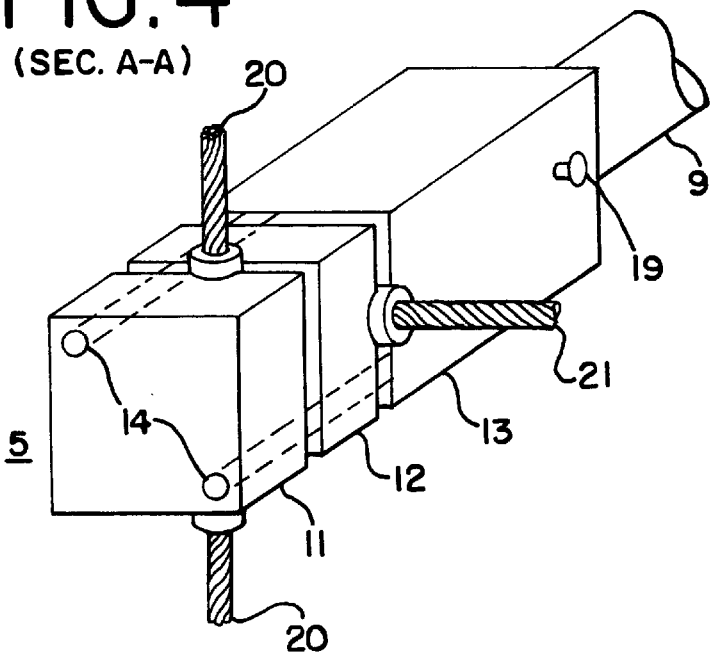
FIG. 4 is a front schematic perspective view of a cutting member showing an attachment member, two cutting arms, and a motor shaft.

In addition to those two holes each of which will eventually accommodate their own cutting arm, as shown in FIG. 3 a shaft-receiving bore hole (25), a shaft-attachment bore hole (17), and two threaded section-attachment bore holes (24) preferably are made in the attachment member (10). Shaft-receiving bore hole (25) preferably is of sufficient size to accommodate shaft (9) as shown in FIG. 1. Shaft-attachment bore hole (17) is preferably of sufficient size to accommodate at least one threaded bolt with locking nut (19) as shown in FIG. 4 which is used to prevent slippage between shaft (9) and attachment member (10) as they rotate. Preferably, threaded bolt with locking nut (19) passes completely through shaft (9) and attachment member (10) such that an interlocking nut may be placed thereon. In addition, threaded bolt (19), preferably, has been hardened for added strength.

The threaded section-attachment holes (24) preferably are approximately three inches in length, run along a longitudinal length of attachment member (10), and may be used along with section-attachment bolts (14) to hold sections (11), (12), and (13) together and to securely contain cutting arms (20) and (21) in insertion grooves (15) and (16) by tightening section attachment bolts (14). The bolts (14) may be contained and secured inside threaded section attachment bore holes (24) which extend from the far end side of front section (11), through middle section (12), and into the end section (13) as shown in FIGS. 3 and 4. When section attachment bolts (14) are tightened, section (11), (12), and (13) are brought into closer contact and compress cutting arms (20) and (21). Due to the semi-rigid and semi-elastic nature of cutting arms (20) and (21) which are preferably comprised of cables, the ends of section bolts (14) do not need a washer to maintain themselves snugly against front section (11) due to their tendency, as they are tightened, to provide a reciprocal compressive force against insertion grooves (15) and (16) and therefore front section (11). Alternatively, simply by loosening said section attachment bolts (14), the attachment member (10) may be readily disassembled for easy replacement of the first and second cutting arms (20) and (21).

The sleeves (22) preferably are placed over the cutting arms (20) and (21) prior to placing and centering them inside attachment member (10). Once in the proper position, the sleeves preferably are hydraulically press fit onto cutting arms (20) and (21) to prevent slippage therefrom. After sleeves (22) are placed on cutting arms (20) and (21), the cutting arms (20) and (21) may be secured into attachment member (10). Primarily, the compression of the cutting arms (20) and (21) inside insertion grooves (15) and (16) achieved by sufficiently tightening section attachment bolt (14), as well as the secondary effect from the secure attachment of sleeves (22) around the attachment member (10) prevents slippage of the cutting arms (20) and (21) during their rotation.

Several aspects of the preferred embodiment of the invention described above contribute to the device's ability to achieve an optimal root-cutting coverage area without damaging the interior wall (6) of pipeline (7) and without the device becoming jammed inside pipeline (7) when encountering a tap-in or joint offset. As described above, the preferred embodiment of the device employs two semi-rigid, longitudinally offset cable cutting arms (20) and (21) each having two sleeves (22) around them. The special features of the semi-rigid cutting arms (20) and (21) which allow themselves to fray during operation, to flex when encountering obstructions, and to longitudinally sweep the pipeline (7), increases the cutting coverage area while avoiding damage to the interior walls (6) of pipeline (7) which may be delicate. As described above, the sleeves (22) add sufficient rigidity to the cutting arms (22) to optimally increase the device's cutting or ripping force to remove stubborn plant roots.

What is claimed is:

1. A device for cleaning objects from a sewer pipeline comprising:

a rotatable shaft having a longitudinal axis;

a cutting member attached to said shaft, said cutting member having a plurality of substantially flexible cutting arms, wherein each of said plurality of cutting arms extend radially to said longitudinal axis of said shaft when rotated;

wherein said cutting member is attached to said shaft by an attachment means which comprises an attachment member and at least one set bolt and nut, wherein said attachment member is attachable to said rotatable shaft with said at least one set bolt and nut; and means for rotating said shaft and said attached cutting member about said longitudinal axis of said shaft at a sufficient angular speed such that said plurality of cutting arms creates a cutting force for cutting an object from within an area through which said plurality of cutting arms circumscribes when said shaft is rotated, said area being substantially perpendicular to said longitudinal axis of said shaft.

2. The device according to claim 1, wherein said attachment member has at least one bore hole and wherein at least a portion of at least one of said plurality of cutting arms is contained in said bore hole to secure said at least one of said plurality of arms in a fixed position relative to said attachment member.

3. The device according to claim 1, wherein at least one of said plurality of cutting arms has at least two ends;

wherein said attachment member has at least one bore hole;

wherein said at least of said plurality of one cutting arms is centered through said at least one bore hole to secure said at least one cutting arm in a fixed position relative to said attachment member; and wherein said at least two ends extend, when said shaft is rotated, an equal distance perpendicular to said longitudinal axis of said shaft.

4. The device according to claim 3, wherein at least one sleeve is placed around said at least one of said plurality of cutting arms that is centered through said at least one bore hole.

5. The device according to one of claims 1 to 4 wherein at least one of said plurality of cutting arms is shorter than the remainder of said plurality of cutting arms.

6. A device for the removal of plant roots from a sewer pipeline comprising:

a rotatable shaft having a longitudinal axis;

an attachment member attached to said shaft, said attachment member comprising:

a rotatable cutting member portion, said cutting member portion comprising:

a first steel cable having two ends, said first steel cable being centered in said cutting member portion so that when said shaft is rotated each of said ends of said first steel cable protrude radially from said cutting member portion substantially perpendicular to said longitudinal axis and each of said ends protrudes a substantially equal distance from said longitudinal axis as said other end; and a second steel cable having two ends, said second steel cable being centered in said cutting member portion so that when said shaft is rotated each of said ends of said second steel cable protrude radially from said cutting member portion substantially perpendicular to said longitudinal axis and each of said ends protrudes as substantially equal distance from said longitudinal axis as said other end;

wherein said first steel cable and said second steel cable are secured in said cutting member portion by at least one sleeve placed around each of said steel cables;

wherein said first steel cable is axially offset from said second steel cable; and a motor in operational connection with said rotatable shaft for rotating said rotatable shaft and said attached attachment member at a sufficient angular speed about said longitudinal axis so that said cutting member portion creates a cutting force for cutting an object from an area through which said first and second cables circumscribe when said shaft is rotated, said area being substantially perpendicular to said longitudinal axis.

7. The device according to claim 6, wherein said first steel cable is shorter than said second steel cable.

* * * * *